US008499820B2

(12) United States Patent
Ondrovic et al.

(10) Patent No.: US 8,499,820 B2
(45) Date of Patent: Aug. 6, 2013

(54) STRIP CASTING APPARATUS WITH INDEPENDENT DELIVERY NOZZLE AND SIDE DAM ACTUATORS

(75) Inventors: Jay Jon Ondrovic, Brownsburg, IN (US); Eric Fulbright, Paragould, AR (US); Katsumi Nakayama, Tokyo (JP)

(73) Assignee: Nucor Corporation, Charlotte, NC (US)

( * ) Notice: Subject to any disclaimer, the term of this patent is extended or adjusted under 35 U.S.C. 154(b) by 0 days.

(21) Appl. No.: 13/558,778

(22) Filed: Jul. 26, 2012

(65) Prior Publication Data

US 2012/0285651 A1 Nov. 15, 2012

Related U.S. Application Data

(62) Division of application No. 12/145,226, filed on Jun. 24, 2008, now Pat. No. 8,251,127.

(51) Int. Cl.
*B22D 11/06* (2006.01)
*B22D 11/10* (2006.01)

(52) U.S. Cl.
USPC ..... 164/428; 164/438; 164/439

(58) Field of Classification Search
USPC ..... 164/8, 435, 436, 438, 439, 480, 428
See application file for complete search history.

(56) References Cited

U.S. PATENT DOCUMENTS

| | | | |
|---|---|---|---|
| 4,811,780 | A | 3/1989 | Yamauchi et al. |
| 4,830,089 | A | 5/1989 | Carmichael et al. |
| 4,869,310 | A | 9/1989 | Yanagi et al. |
| 5,058,657 | A | 10/1991 | Hasegawa et al. |
| 5,060,714 | A | 10/1991 | Yamauchi et al. |
| 5,207,265 | A | 5/1993 | Hasegawa et al. |
| 5,584,335 | A | 12/1996 | Barbéet al. |
| 5,588,479 | A | 12/1996 | Leadbetter et al. |
| 5,787,968 | A | 8/1998 | Lauener |
| 6,032,722 | A | 3/2000 | Russell et al. |
| 6,237,673 | B1 | 5/2001 | Kato et al. |

(Continued)

FOREIGN PATENT DOCUMENTS

| | | | |
|---|---|---|---|
| EP | 0967032 | A2 | 12/1999 |
| GB | 2296883 | A | 7/1996 |

(Continued)

OTHER PUBLICATIONS

AU2008904323 International Search Report, date of mailing of Search Report—Sep. 17, 2008; 3 pages.

*Primary Examiner* — Kevin P Kerns
*Assistant Examiner* — Steven Ha
(74) *Attorney, Agent, or Firm* — Hahn, Loeser & Parks LLP; Arland T. Stein

(57) ABSTRACT

An apparatus for casting metal strip includes a pair of counter-rotatable casting rolls having casting surfaces laterally positioned to form a nip therebetween through which cast strip can be cast, and on which a casting pool of molten metal can be formed supported on the casting surfaces above the nip, a pair of molten metal delivery nozzles disposed above the nip and capable of discharging molten metal to form the casting pool supported on the casting rolls, a pair of side dams adjacent ends of the pair of casting rolls capable of confining the casting pool, a pair of delivery nozzle actuators capable of positioning the delivery nozzles independently of the side dams and a pair of side dam actuators capable of positioning the side dams independently of the delivery nozzles during casting, and a control system capable of controlling desired distance between the delivery nozzles and the side dams.

4 Claims, 6 Drawing Sheets

U.S. PATENT DOCUMENTS

| | | | |
|---|---|---|---|
| RE37,214 | E | 6/2001 | Barbéet al. |
| 6,296,045 | B1 | 10/2001 | Fox et al. |
| 6,363,999 | B1 | 4/2002 | Smith |
| 6,588,492 | B1 | 7/2003 | Fish et al. |
| 6,739,382 | B2 | 5/2004 | De Luca et al. |
| 6,910,523 | B2 | 6/2005 | Fish et al. |
| 7,066,238 | B2 | 6/2006 | Hohenbichler et al. |
| 7,147,035 | B2 | 12/2006 | Fish et al. |
| 7,363,958 | B2 | 4/2008 | Fehleman et al. |
| 2006/0054298 | A1 | 3/2006 | Hohenbichler et al. |
| 2006/0102312 | A1 | 5/2006 | Poloni et al. |

FOREIGN PATENT DOCUMENTS

| | | | |
|---|---|---|---|
| GB | 2337016 | A | 4/1999 |
| JP | 55-024722 | A | 2/1980 |
| JP | 61042454 | A | 2/1986 |
| JP | 61144245 | A | 7/1986 |
| JP | 2000000641 | A | 1/2001 |

STRIP CASTING APPARATUS WITH INDEPENDENT DELIVERY NOZZLE AND SIDE DAM ACTUATORS

RELATED APPLICATION

This application is a divisional application of and claims priority to and the benefit of U.S. patent application Ser. No. 12/145,226, filed Jun. 24, 2008, now U.S. Pat. No. 8,251,127, the disclosure of which is incorporated herein by reference in its entirety.

BACKGROUND AND SUMMARY

This invention relates in general to the casting of metal strip by continuous casting in a twin roll caster.

In a twin roll caster molten metal is introduced between a pair of counter-rotated horizontal casting rolls that are cooled so that metal shells solidify on the moving roll surfaces, and are brought together at a nip between them to produce a solidified strip product delivered downwardly from the nip between the rolls. The term "nip" is used herein to refer to the general region at which the rolls are closest together. The molten metal may be poured from a ladle into a smaller vessel or series of smaller vessels from which it flows through a metal delivery nozzle or series of delivery nozzles (also called the "core nozzles") located above the nip, forming a casting pool of molten metal supported on the casting surfaces of the rolls immediately above the nip and extending along the length of the nip. This casting pool is usually confined between side plates or dams held in sliding engagement with end surfaces of the casting rolls so as to dam the two ends of the casting pool against outflow.

Further, the twin roll caster may be capable of continuously producing cast strip from molten steel through a sequence of ladles. Pouring the molten metal from the ladle into a smaller vessel before flowing through the metal delivery nozzle enables the exchange of an empty ladle with a full ladle without disrupting the production of cast strip.

During operation, in order to inhibit certain defects from occurring in the cast strip, it is important to maintain certain desired conditions of the molten metal in the casting pool, including temperature, composition and flow rate. Particularly important to casting quality thin strip is controlling the flow rate and molten metal temperature in the area where the side dams, casting rolls and meniscus of the casting pool intersect, the "triple point" area or region. The formation of pieces of solid metal known as "skulls" in the casting pool in the vicinity of the confining side plates or dams have been observed. The rate of heat loss from the casting pool is higher near the side dams (called the "triple point region") due to conductive heat transfer through the side dams to the casting roll ends. This localized heat loss near the side dams has a tendency to form "skulls" of solid metal in that region, which can grow to a considerable size and fall between the casting rolls and causing defects in the cast strip. An increased flow of molten metal to these "triple point" regions, the regions near the side dams, have been provided by separate direct flows of molten metal to these triple point regions. Examples of such proposals may be seen in U.S. Pat. No. 4,694,887 and in U.S. Pat. No. 5,221,511. Increased heat input to these triple point regions has inhibited formation of skulls.

To control flow in the triple area, the distance between the side dams and the ends of the delivery nozzles nearest the side dams should be controlled and maintained substantially constant. This distance has been found so sensitive that even compensation for wear of the side dams and the delivery nozzles needs to addressed. These components typically wear at different rates. The approach in the past has been to provide a common support for each side dam and adjacent portion of the delivery nozzle. Coupling of the positioning and support for the delivery nozzles and side dams enabled the distance between the side dams and nearest end of a delivery nozzle to be maintained.

Apparatus and method for controlling and maintaining a set distance between the outer ends of the delivery nozzles and the side dams during a campaign is disclosed in U.S. Pat. Nos. 6,910,523, 6,588,492, 7,147,035. The apparatus and method disclosed has a carriage assembly for commonly supporting the side dams and nearest delivery nozzles to maintain distance between the side dams and ends of the delivery nozzles at a set distance with wear of the side dams. This common support was believed important to maintain the distance between the side dam and end of the delivery nozzle. Although the delivery nozzles could be moved relative to the side dams by the carriage assembly, the movement also involved simultaneously moving of both delivery nozzle and the adjacent side dam to maintain the distance between the side dam and end of the delivery nozzle. This movement affects the side dam force and thus side dam wear. Moreover, the movement of the side dam by the support to compensate for wear of the side dam required repositioning of the delivery nozzle to maintain the distance between the side dam and the end of the nearest delivery nozzle.

We have found that quality of thin strip casting particularly with control of "skulls" in the "triple point" can be improved by entirely different approach with separate segregated control of each of the side dams and each adjacent delivery nozzle during a casting campaign. The distance between the side dams and the nozzle may be continually varied if desired. Accordingly, we have disclosed a method for casting metal strip comprising:

(a) assembling a pair of counter-rotatable casting rolls to form a nip there between through which thin strip can be cast, and a pair of confining side dams adjacent the ends of the casting capable of supporting a casting pool of molten metal formed on the casting surfaces above the nip, (b) assembling an elongated metal delivery nozzle with a plurality of moveable metal delivery nozzles disposed axially along and above the nip and capable of discharging molten metal to form the casting pool supported on the casting supports of the casting rolls, (c) assembling delivery nozzle actuators each capable of axial movement of the delivery nozzles relative to the adjacent side dam separate from the movement of the adjacent side dam, and side dam actuators each capable of axial movement of the side dams separate from the movement of the delivery nozzles during casting, and (d) controlling a desired distance between the delivery nozzles and the side dams by the axial movement of the delivery nozzle actuators and side dam actuators.

The method of continuously casting metal strip may have only a pair of delivery nozzles. In this embodiment, there is two delivery nozzles arranged end-to-end, and two side dams arranged adjacent the outside ends of the two delivery nozzles along the nip between the casting rolls. The delivery nozzle actuators and side dam actuators are positioned adjacent the ends of the casting rolls to provide axial movement of the delivery nozzles and the side dams along the direction of the nip between the casting rolls.

The method of continuously casting metal strip may further comprise the following steps:

(e) positioning sensors to sense the positions of the side dams and of the delivery nozzles nearest the side dams, and produce electrical signals indicative of said positions of the side dams and of the delivery nozzles nearest the side dams positions, (f) controlling the positions of the side dams and of the delivery nozzles nearest the side dams responsive to said electrical signals produced by the sensors so as to adjust the positions of the side dams and of the delivery nozzles nearest the side dams responsive to wear of said the side dams and of the delivery nozzles nearest the side dams.

Alternatively or in addition, the method of continuously casting metal strip may comprise forming a groove in each side dam and controlling the depth of the groove in each side dam during a casting campaign by wear from molten metal. This may be done by controlling force exerted by the side dame actuators.

As disclosed is an apparatus for continuously casting metal strip comprising:

(a) a pair of counter-rotatable casting rolls laterally positioned to form a nip there between through which thin strip can be cast, and a pair of confining side dams adjacent the ends of the casting capable of supporting a casting pool of molten metal formed on the casting surfaces above the nip, (b) an elongated metal delivery nozzle with a plurality of moveable metal delivery nozzles disposed axially along and above the nip and capable of discharging molten metal to form the casting pool supported on the casting supports of the casting rolls, (c) delivery nozzle actuators each capable of axial movement of the delivery nozzles relative to the adjacent side dam separate from the movement of the adjacent side dam, (d) side dam actuators each capable of axial movement of the side dams separate from the movement of the delivery nozzles during casting, and (e) a control system capable of actuating delivery nozzle actuators and actuating delivery nozzle actuators to control the distances between the side dams and the delivery nozzles nearest the side dams by separate axial movement of the delivery nozzle actuators and side dam actuators.

The apparatus for continuously casting metal strip may be only a pair of delivery nozzles. In this embodiment, there is two delivery nozzles arranged end-to-end, and two side dams arranged adjacent the outside ends of the two delivery nozzles along the nip between the casting rolls. The delivery nozzle actuators and side dam actuators are positioned adjacent the ends of the casting rolls to provide axial movement of the delivery nozzles and the side dams along the direction of the nip between the casting rolls.

The apparatus for continuously casting metal strip may further comprise:

(f) sensors capable of sensing the positions of the side dams and the positions of the delivery nozzles nearest the side dams, and produce electrical signals indicative of said positions of the side dams and of the delivery nozzles nearest the side dams positions, to the control system, (g) where the control system is capable of controlling the positions of the side dams and the positions of the delivery nozzles nearest the side dams responsive to said electrical signals produced by the sensors so as to adjust the positions of the side dams and of the delivery nozzles nearest the side dams responsive to wear of said the side dams and of the delivery nozzles nearest the side dams.

The apparatus for continuously casting metal strip further a control system controls the side dam actuators to cause a groove to be formed in each side dam to controlled the depth during a casting campaign by wear from molten metal.

In either of method for continuously casting metal strip or the apparatus for continuous casting metal strip, the delivery nozzle actuators and side dam actuators may be selected from the group consisting of servo-mechanisms, hydraulic mechanisms, pneumatic mechanisms, gear mechanisms, cog actuators, drive chain mechanisms, pulley and cable mechanisms, drive screw mechanisms, jack actuators, rack and pinion mechanisms, electro-mechanical actuators, electric motors, linear actuators, and rotating actuators.

Various aspects of this invention will become apparent from the following detailed description and accompanying drawings.

DETAILED DESCRIPTION

Figure 1:
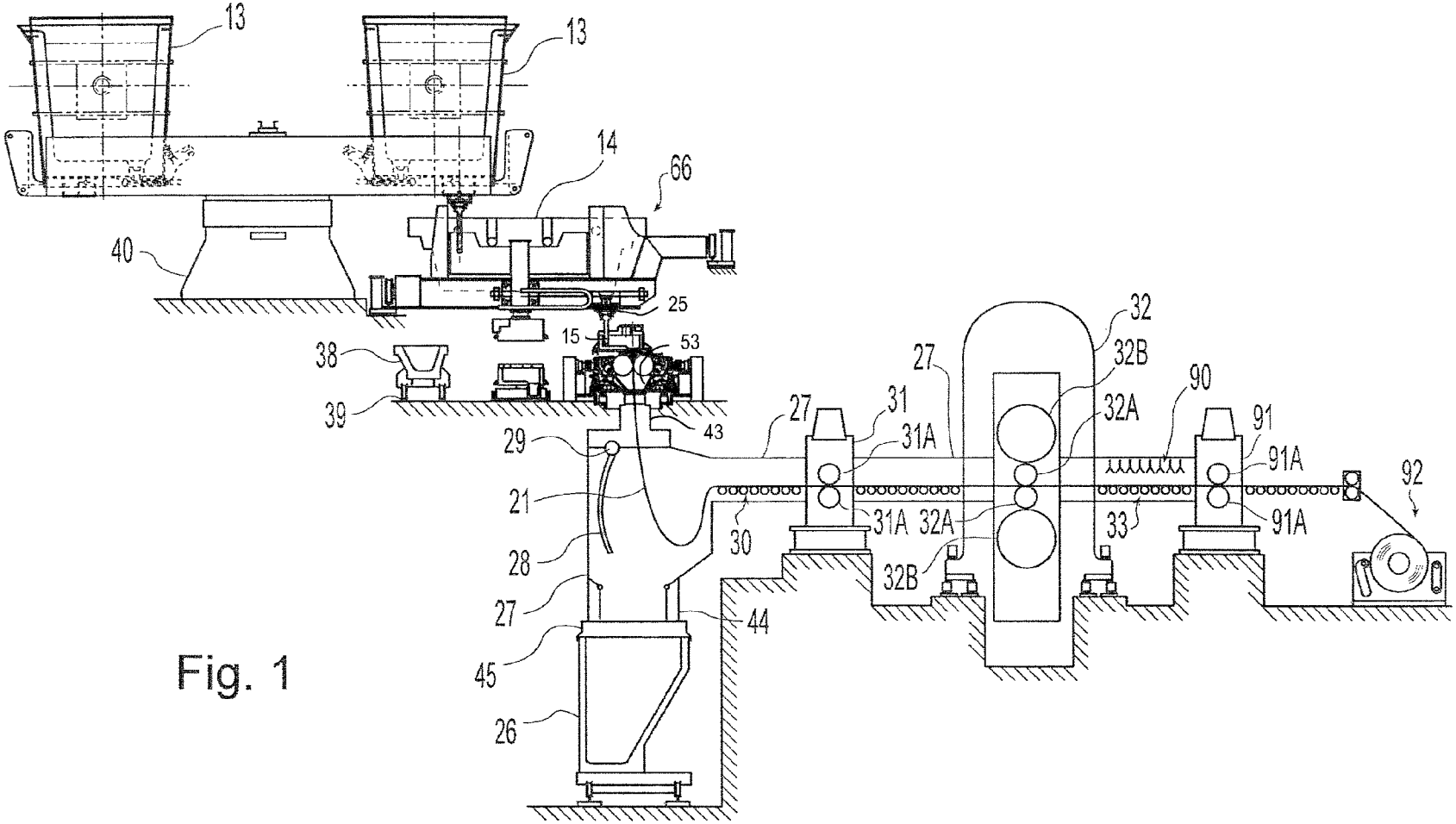
FIG. 1 is a diagrammatical side view of a portion of twin roll caster of the present disclosure.
Figure 2:
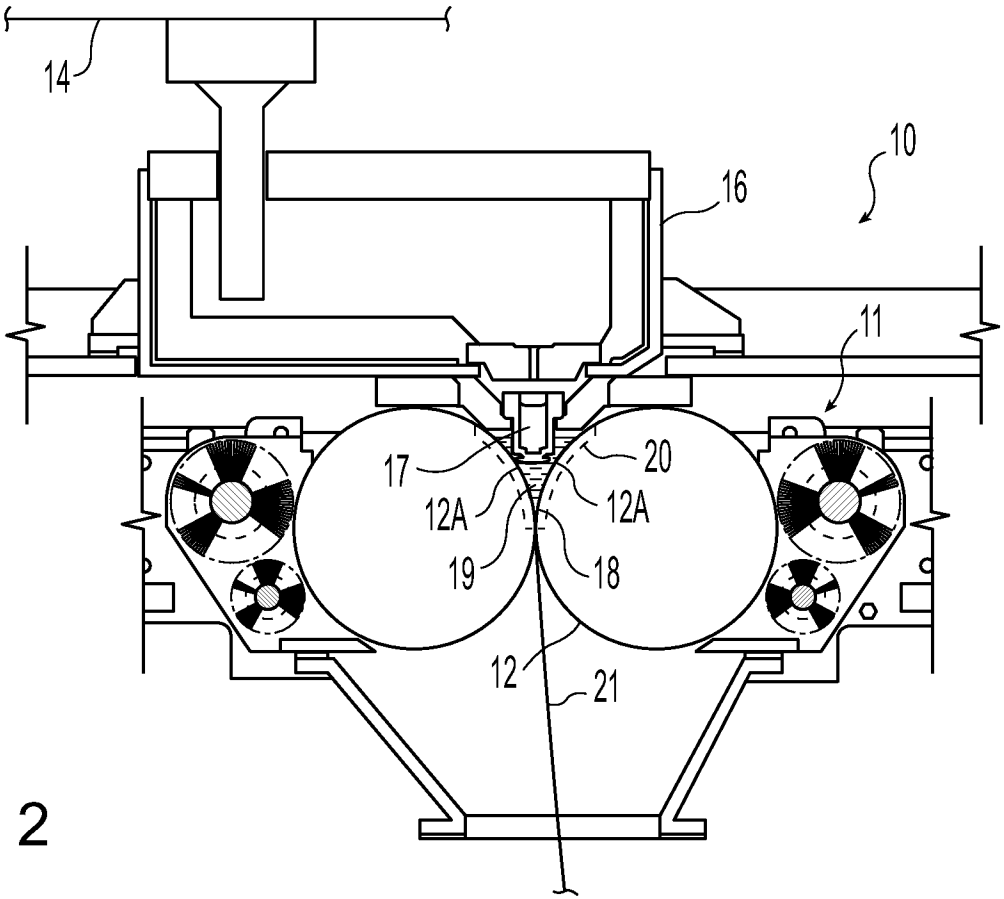
FIG. 2 is a partial sectional view through the casting rolls mounted in a roll cassette in the casting position of the caster of FIG. 1.
Figure 3:
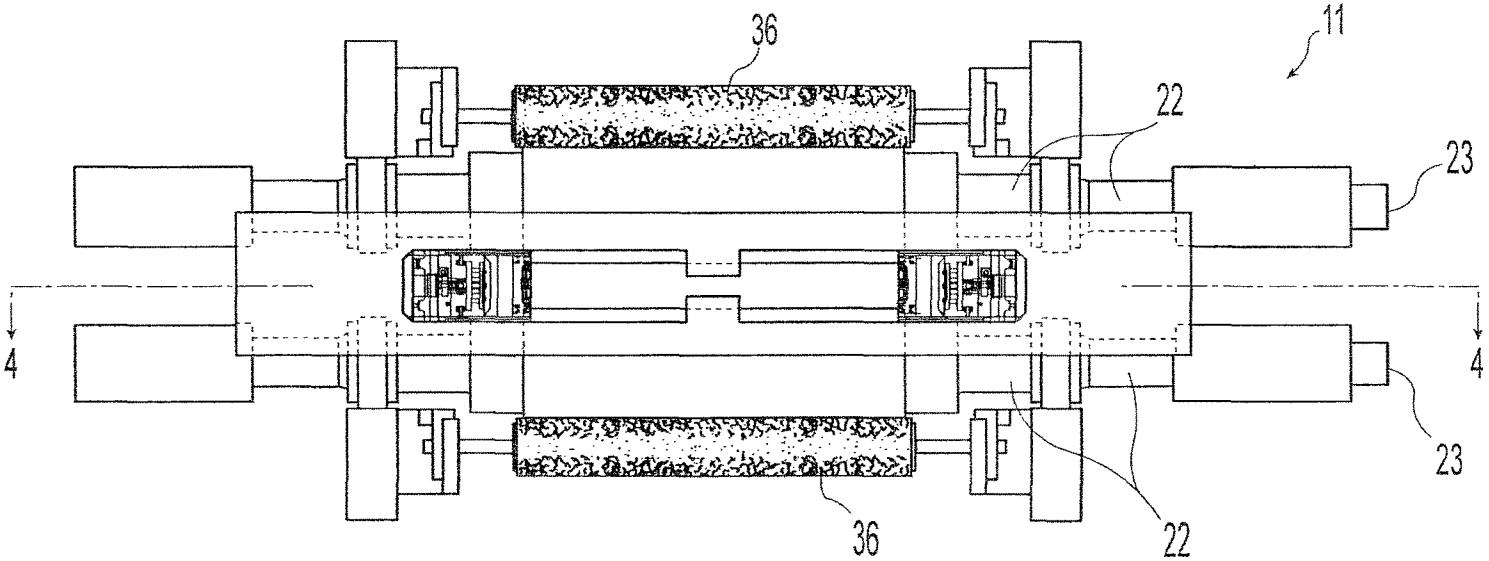
FIG. 3 is diagrammatical plan view of the roll cassette of FIG. 2 removed from the caster.

Referring now to the drawings, there is illustrated in FIGS. 1 and 2 a portion of a twin roll caster for continuously casting thin steel strip that comprises a main machine frame 10 that that stands up from the factory floor and supports a roll cassette module 11 including a pair of counter-rotatable casting rolls 12 mounted therein. The casting rolls 12 having casting surfaces 12A laterally positioned to form a nip 18 there between. The casting rolls 12 are mounted in the roll cassette 11 for ease of operation and movement. The roll cassette facilitates rapid movement of the casting rolls ready for casting from a setup position into an operative casting position in the caster as a unit, and ready removal of the casting rolls from the casting position when the casting rolls are to be replaced. There is no particular configuration of the roll cassette that is desired, so long as it performs that function of facilitating movement and positioning of the casting rolls.

Molten metal is supplied from a ladle (not shown) through a metal delivery system, such as a movable tundish 14 and a transition piece or distributor 16. From the distributor 16, the molten metal flows to at least one metal delivery nozzle 17, or core nozzle, positioned between the casting rolls 12 above the nip 18. Molten metal discharged from the delivery nozzle 17 thus delivered forms a casting pool 19 of molten metal above the nip 18 supported on the casting surfaces 12A of the casting rolls 12. This casting pool 19 is confined in the casting area at the ends of the casting rolls 12 by a pair of side closures or confining plate side dams 20 (shown in dotted line in FIG. 2). The upper surface of the casting pool 19 (generally referred to as the "meniscus" level) may rise above the bottom portion of the delivery nozzle 17 so that the lower part of the delivery nozzle 17 is immersed in the casting pool 19. The casting area includes the addition of a protective atmosphere above the casting pool 19 to inhibit oxidation of the molten metal in the casting area.

The ladle 13 typically is of a conventional construction supported on a rotating turret 40. For metal delivery, the ladle 13 is positioned over a movable tundish 14 in the casting position to fill the tundish with molten metal. The movable tundish 14 may be positioned on a tundish car 66 capable of transferring the tundish from a heating station (not shown), where the tundish is heated to near a casting temperature, to the casting position. A tundish guide, such as rails, may be positioned beneath the tundish car 66 to enable moving the movable tundish 14 from the heating station to the casting position.

The movable tundish 14 may be fitted with a slide gate 25, actuable by a servo mechanism, to allow molten metal to flow from the tundish 14 through the slide gate 25, and then through a refractory outlet shroud 15 to a transition piece or distributor 16 in the casting position. From the distributor 16, the molten metal flows to the delivery nozzle 17 positioned between the casting rolls 12 above the nip 18.

The casting rolls 12 are internally water cooled so that as the casting rolls 12 are counter-rotated, shells solidify on the casting surfaces 12A as the casting surfaces 12A move into contact with and through the casting pool 19 with each revolution of the casting rolls 12. The shells are brought together at the nip 18 between the casting rolls 12 to produce a solidified thin cast strip product 21 delivered downwardly from the nip 18. The gap between the casting rolls is such as to maintain separation between the solidified shells at the nip so that semi-solid metal is present in the space between the shells through the nip, and is, at least in part, subsequently solidified between the solidified shells within the cast strip below the nip.

FIG. 1 shows the twin roll caster producing the thin cast strip 21, which passes across a guide table 30 to a pinch roll stand 31, comprising pinch rolls 31A. Upon exiting the pinch roll stand 31, the thin cast strip may pass through a hot rolling mill 32, comprising a pair of work rolls 32A, and backup rolls 32B, forming a gap capable of hot rolling the cast strip delivered from the casting rolls, where the cast strip is hot rolled to reduce the strip to a desired thickness, improve the strip surface, and improve the strip flatness. The work rolls 32A have work surfaces relating to the desired strip profile across the work rolls. The hot rolled cast strip then passes onto a run-out table 33, where it may be cooled by contact with a coolant, such as water, supplied via water jets 90 or other suitable means, and by convection and radiation. In any event, the hot rolled cast strip may then pass through a second pinch roll stand 91 to provide tension of the cast strip, and then to a coiler 92. The cast strip may be between about 0.3 and 2.0 millimeters in thickness before hot rolling.

At the start of the casting operation, a short length of imperfect strip is typically produced as casting conditions stabilize. After continuous casting is established, the casting rolls are moved apart slightly and then brought together again to cause this leading end of the cast strip to break away forming a clean head end of the following cast strip. The imperfect material drops into a scrap receptacle 26, which is movable on a scrap receptacle guide. The scrap receptacle 26 is located in a scrap receiving position beneath the caster and forms part of a sealed enclosure 27 as described below. The enclosure 27 is typically water cooled. At this time, a water-cooled apron 28 that normally hangs downwardly from a pivot 29 to one side in the enclosure 27 is swung into position to guide the clean end of the cast strip 21 onto the guide table 30 that feeds it to the pinch roll stand 31. The apron 28 is then retracted back to its hanging position to allow the cast strip 21 to hang in a loop beneath the casting rolls in enclosure 27 before it passes to the guide table 30 where it engages a succession of guide rollers.

An overflow container 38 may be provided beneath the movable tundish 14 to receive molten material that may spill from the tundish. As shown in FIG. 1, the overflow container 38 may be movable on rails 39 or another guide such that the overflow container 38 may be placed beneath the movable tundish 14 as desired in casting locations. Additionally, an overflow container may be provided for the distributor 16 adjacent the distributor (not shown).

The sealed enclosure 27 is formed by a number of separate wall sections that fit together at various seal connections to form a continuous enclosure wall that permits control of the atmosphere within the enclosure. Additionally, the scrap receptacle 26 may be capable of attaching with the enclosure 27 so that the enclosure is capable of supporting a protective atmosphere immediately beneath the casting rolls 12 in the casting position. The enclosure 27 includes an opening in the lower portion of the enclosure, lower enclosure portion 44, providing an outlet for scrap to pass from the enclosure 27 into the scrap receptacle 26 in the scrap receiving position. The lower enclosure portion 44 may extend downwardly as a part of the enclosure 27, the opening being positioned above the scrap receptacle 26 in the scrap receiving position. As used in the specification and claims herein, "seal," "sealed," "sealing," and "sealingly" in reference to the scrap receptacle 26, enclosure 27, and related features may not be a complete seal so as to prevent leakage, but rather is usually less than a perfect seal as appropriate to allow control and support of the atmosphere within the enclosure as desired with some tolerable leakage.

A rim portion 45 may surround the opening of the lower enclosure portion 44 and may be movably positioned above the scrap receptacle, capable of sealingly engaging and/or attaching to the scrap receptacle 26 in the scrap receiving position. The rim portion 45 may be movable between a sealing position in which the rim portion engages the scrap receptacle, and a clearance position in which the rim portion 45 is disengaged from the scrap receptacle. Alternately, the caster or the scrap receptacle may include a lifting mechanism to raise the scrap receptacle into sealing engagement with the rim portion 45 of the enclosure, and then lower the scrap receptacle into the clearance position. When sealed, the enclosure 27 and scrap receptacle 26 are filled with a desired gas, such as nitrogen, to reduce the amount of oxygen in the enclosure and provide a protective atmosphere for the cast strip.

The enclosure 27 may include an upper collar portion 43 supporting a protective atmosphere immediately beneath the casting rolls in the casting position. When the casting rolls 12 are in the casting position, the upper collar portion 43 is moved to the extended position closing the space between a housing portion 53 adjacent the casting rolls 12, as shown in FIG. 2, and the enclosure 27. The upper collar portion 43 may be provided within or adjacent the enclosure 27 and adjacent the casting rolls, and may be moved by a plurality of actuators (not shown) such as servo-mechanisms, hydraulic mechanisms, pneumatic mechanisms, and rotating actuators.

Figure 4:
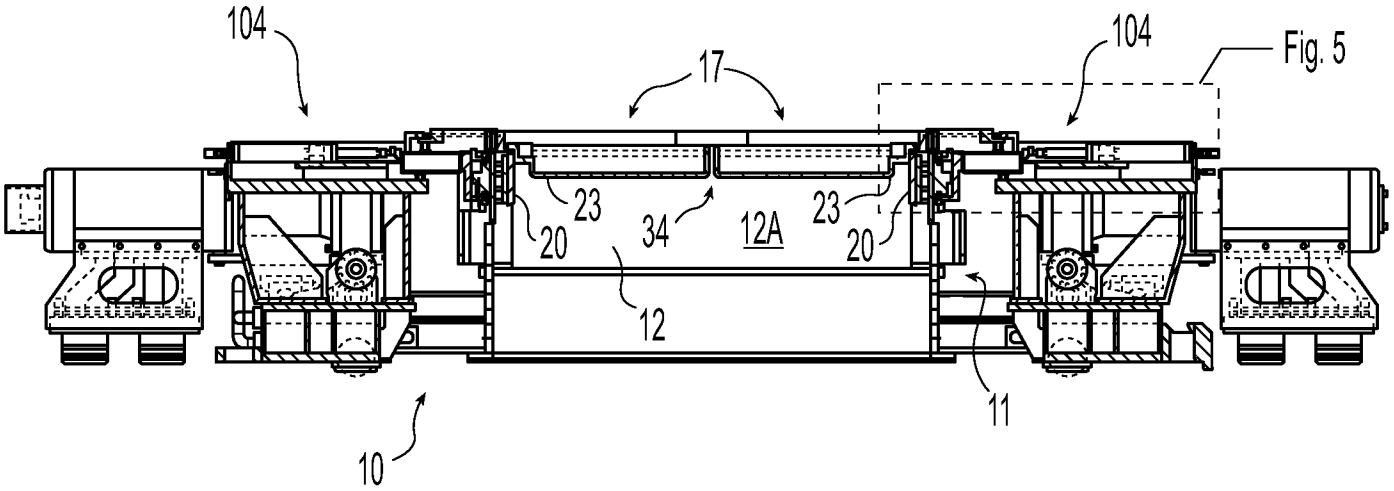
FIG. 4 is a transverse partial sectional view of through the portion marked 4-4 in FIG. 3.

There is shown in FIG. 4 a pair of delivery nozzles 17 formed as substantially identical segments made of a refractory material such as zirconia graphite, alumina graphite or any other suitable material. It must be understood that more than two delivery nozzles 17 may be used in any different sizes and shapes if desired. The delivery nozzles 17 need not be substantially identical in size and shape, although generally such is desirable to facilitate fabrication and installation. Two delivery nozzles 17 may be provided each capable of moving independently of the other above the casting rolls 12.

Typically where two delivery nozzles 17 are used the nozzles 17 are disposed and supported in end-to-end relationship along the nip 18 with a gap 34 therebetween, so that each delivery nozzle 17 can be moved inwardly toward each other during a casting campaign as explained below. It must be understood, however, that any suitable number of delivery nozzles 17 may be used, including two delivery nozzles 17 as described below and including any additional number of nozzles 17 disposed therebetween. For example there may be a central nozzle segment abutted by outer nozzle segments on either side.

Each delivery nozzle 17 may formed in one piece or multiple pieces. As shown, each nozzle 17 includes an end wall 23 positioned nearest a confining side dam 20 as explained below. Each end wall 23 may be configured to achieve a particular desired molten metal flow in the triple point region between the casting rolls 12 and the respective side dam 20.

The side dams 20 may be made from a refractory material such as zirconia graphite, graphite alumina, boron nitride, boron nitride-zirconia, or other suitable composites. The side dams 20 have a face surface capable of physical contact with the casting rolls and molten metal in the casting pool.

Figure 5:
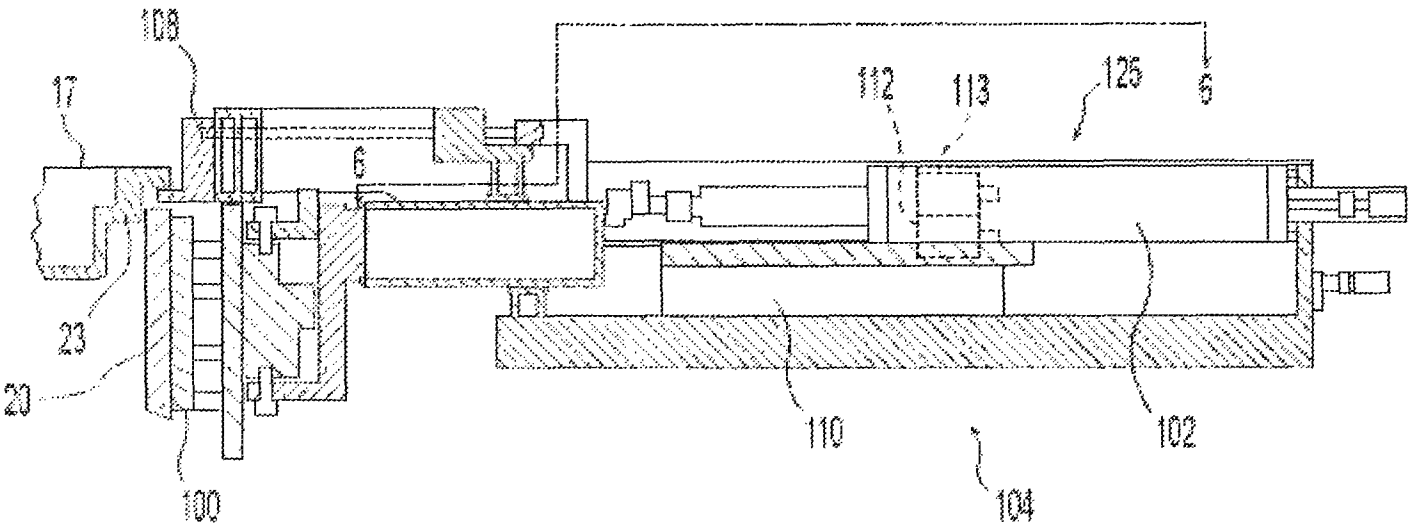
FIG. 5 is an enlarged view of one of the carriage assemblies marked as detail 5 in FIG. 4.
Figure 6:
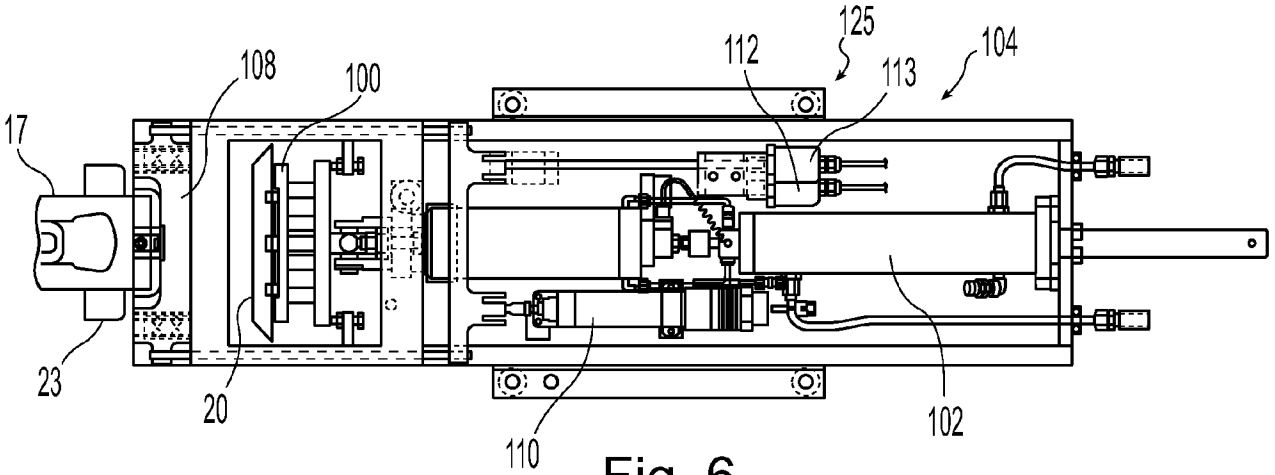
FIG. 6 is a plan view partially in section of the carriage assembly of FIG. 5 with the side dam in a first position.
Figure 7:
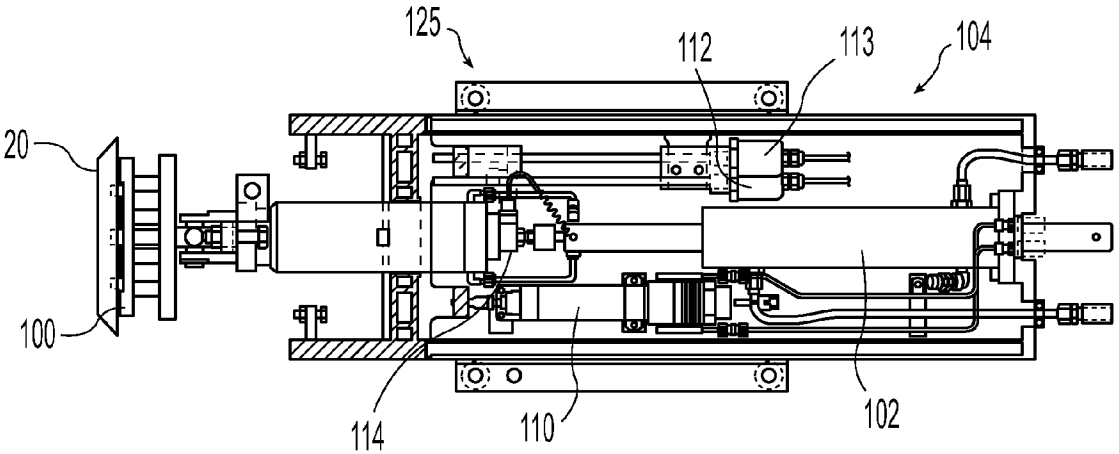
FIG. 7 is a view similar to FIG. 6 with the side dam in a second position.

A pair of carriage assemblies, generally indicated at 104, are provided to position the side dams 20 and the delivery nozzles 17. As illustrated, the twin roll caster is generally symmetrical, although such is not required. Referring to FIGS. 5-7, one carriage assembly 104 is illustrated and described below, with the other carriage assembly 104 being generally similar. It is understood that the twin roll caster may utilize any number of carriage assemblies 104 configured in any suitable manner to provide a flow of molten metal to the casting pool 19. Each carriage assembly 104 is disposed at one end of the pair of casting rolls 12. Each carriage assembly 104 may be mounted fixed relative to the machine frame 10, or may be moveable axially toward and away from the casting rolls 12 to enable the spacing between the carriage assembly 104 and the casting rolls 12 to be adjusted. The carriage assemblies 104 may be preset in final position before a casting campaign to suit the width of the casting rolls 12 for the strip to be cast, or the position of the carriage assembly 104 may be adjusted as desired during a casting campaign. The carriages 104 may be positioned one at each end of the roll assembly and moveable toward and away from one another to enable the spacing between them to be adjusted. The carriages can be preset before a casting operation according to the width of the casting rolls and to allow quick roll changes for differing strip widths. The carriages 104 may be positioned so as to extend horizontally above the casting rolls with the nozzles 17 positioned beneath the distributor 16 in the casting position and at a central position to receive the molten metal.

For example the carriage assembly 104 may be positioned from tracks (not shown) on the machine frame 10, which may be mounted by clamps or any other suitable mechanism. Alternatively, the carriage assembly 104 may be supported by its own support structure relative to the casting rolls 12.

The carriage assembly 104 includes a support frame 125. A nozzle bridge 108 is moveably connected to the support frame 125 and engages the delivery nozzles 17 for selective movement thereof. A nozzle actuator 110 is mounted to the support frame 125 and connected to the nozzle bridge 108 for moving the nozzle bridge 108 and thus moving the delivery nozzles 17 to position the end wall 23 relative to the side dam 20. The nozzle actuator 110 is thus capable of positioning the delivery nozzles 17. The nozzle actuator 110 is a conventional servo mechanism. It must be understood, however, that the nozzle actuator 110 may be any drive mechanism suitably move and adjust delivery nozzles 17. For example, the nozzle actuator 110 may be a screw jack drive operated by an electric motor, a hydraulic mechanism, a pneumatic mechanism, a gear mechanisms, a cog, a drive chain mechanism, a pulley and cable mechanism, a drive screw mechanism, a jack actuator, a rack and pinion mechanism, an electro-mechanical actuator, an electric motor, a linear actuator, a rotating actuator, or any other suitable device.

A nozzle position sensor 113 senses the position of the delivery nozzles 17. The nozzle position sensor 113 is a linear displacement sensor to measure the change in position of the nozzle bridge 108 relative to the support frame 125. The nozzle position sensor 113 may be any sensor suitable to indicate any parameter representative of a position of the delivery nozzles 17. For example, the nozzle position sensor 113 may be linear variable displacement transformer to respond to the extension of the nozzle actuator 110 to provide signals indicative of movement of the delivery nozzles 17, or an optical imaging device for tracking the position of the delivery nozzles 17 or any other suitable device for determining the location of the delivery nozzles 17.

The side dam 20 is mounted to a plate holder 100 which is moveably connected to the support frame 125 and engages the side dam 20 for selective movement thereof. A side dam actuator 102 is mounted to the support frame 125 and connected to the plate holder 100 for moving the plate holder 100 and thus moving each side dam 20 to position the side dam 20 relative to the casting rolls 12. The side dam actuator 102 is thus capable of positioning the side dam 20. The side dam actuator 102 is a hydraulic force cylinder. It must be understood, however, that the side dam actuator 102 may be any suitable drive mechanism to position the plate holder 100 to bring the side dam 20 into engagement with the casting rolls 12 to confine the casting pool 19 formed on the casting surfaces 12A during a casting operation. Such a suitable drive mechanism, for example, may be a servo mechanisms, a screw jack drive operated by electric motor, a pneumatic mechanism, a gear mechanisms, a cog, a drive chain mechanism, a pulley and cable mechanism, a drive screw mechanism, a jack actuator, a rack and pinion mechanism, an electro-mechanical actuator, an electric motor, a linear actuator, a rotating actuator, or any other suitable device. Thus, the side dams 20 are mounted in side dam plate holders 100, which are movable by side dam actuators 102, such as a servo mechanism, to bring the side dams 20 into engagement with the ends of the casting rolls. Additionally, the side dam actuators 102 are capable of positioning the side dams 20 during casting. The side dams 20 thus form end closures for the molten pool of metal on the casting rolls during the casting operation.

A side dam position sensor 112 senses the position of the side dam 20. The side dam position sensor 112 is a linear displacement sensor to measure the actual change in position of the plate holder 100 relative to the support frame 125. The side dam position sensor 112 may be any sensor suitable to indicate any parameter representative of a position of the side dam 20. For example, the side dam position sensor 112 may be linear variable displacement transducer to respond to the extension of the side dam actuator 102 to provide signals indicative of position of the side dam 20, or an optical imaging device for tracking the position of the side dam 20 or any other suitable device for determining the location of the side dam 20. The side dam position sensor 112 may also or alternatively include a force sensor, or load cell for determining the force urging the side dam 20 against the casting rolls 12 and providing electrical signals indicative of the force urging the side dam plate against the casting rolls.

In any case the actuators 110 and 102 and the sensors 113 and 112 may be connected into a control system in the form of a circuit receiving control signals determined by measurement of the distance variation between the delivery nozzles 17 and the confining plate side dams 20 and the side dams 20 and the casting rolls 12. For example, small water cooled video cameras may be installed on the nozzle bridge 108, or any other suitable structure, to directly observe the distance between the delivery nozzles 17 and the confining plate side dams 20 and the side dams 20 and the casting rolls 12, and to produce control signals to be fed to position encoders on the actuators 110 and 102. With any arrangement, precise control of the distance between the end walls 23 and the side dams 20 and the side dams 20 and the casting rolls 12 may be maintained. Moreover these distances can be accurately set and maintained by independent operation of the actuators 110 and 102 during casting. For example, the distance between the end wall 23 and the side dam 20 may be set so that a discharge of molten metal is positioned to a target area on the side dam 20 relative to the triple point regions.

For example, the side dam 20 is shown in a first position in FIG. 6 and in a second position in FIG. 7 having been independently moved with regards to the delivery nozzles 17 and relative to the support frame 125.

Over the casting campaign the side dams 20 experience significant wear. With the presently described apparatus and method, the distance between the end walls 23 and the confining plate side dams 20 may be set before casting and then the position of each of the end walls 23 and the side dams 20 adjusted separately and independently of one another. Thus, the desired distance between the side dams 20 and the ends of the delivery nozzles 17 maintained during the casting campaign with wear of the side dams and the delivery nozzles.

Moreover the side dams 20 wear only at their margins which engage the end faces of the casting rolls 12. The inner parts of the confining plate side dams 20 between these margins wears at a substantially lower rate. As wear of the side dams 20 continues they are projected inwardly along the ends of the casting rolls 12 decreasing the distance between the confining plates and the outer nozzle ends. The present invention provides for independent movement of the side dams 20 and the delivery nozzles 17 as this occurs. The independent control of the side dams 20 relative to the movement of the delivery nozzles 17 provided by the present invention also allows for improved applied force control of the side dams 20, thus reducing wear on the side dams 20 and extending the useful life of the side dams 20.

Further, without the presently described apparatus and method, the adjustment of the position of one of the end walls 23 or the applied force of the side dams 20 causes a change of the other. Thus, when the position of one of the end walls 23 or the applied force of one of the side dams 20 is adjusted then the other should also be adjusted to compensate for the change in the former. In such a case, either the delivery nozzles 17 is being unnecessarily disturbed and creating a risk of disturbances in the casting pool 19, or the applied force of the side dam 20 is unnecessarily increased causing additional wear on the side dam 20.

Additionally, it must be understood that the side dam actuator 102 may position the side dam 20 in a particular position with a particular force during casting to wear the side dam 20 on the pair of casting rolls 12 to purposefully change the depth of a groove worn into the side dam 20 between the pair of casting rolls 12 by the cast strip being cast.

While the principle and mode of operation of this invention have been explained and illustrated with regard to particular embodiments, it must be understood, however, that this invention may be practiced otherwise than as specifically explained and illustrated without departing from its spirit or scope.

What is claimed is:

1. Apparatus for continuously casting metal strip comprising:

(a) a pair of counter-rotatable casting rolls laterally positioned to form a nip there between through which thin strip can be cast, and a pair of confining side dams adjacent the ends of the casting capable of supporting a casting pool of molten metal formed on the casting surfaces above the nip, (b) an elongated metal delivery system with a plurality of moveable metal delivery nozzles disposed axially along and above the nip and capable of discharging molten metal to form the casting pool supported on the casting supports of the casting rolls, (c) a carriage assembly including delivery nozzle actuators each capable of axial movement of the delivery nozzles relative to the adjacent side dam separate and independent from the movement of the adjacent side dam and further including side dam actuators each capable of axial movement of the side dams separate and independent from the movement of the delivery nozzles during casting, and (d) a control system capable of actuating delivery nozzle actuators and actuating delivery nozzle actuators to control the distances between the side dams and the delivery nozzles nearest the side dams by separate axial movement of the delivery nozzle actuators and side dam actuators.

2. The apparatus for continuously casting metal strip as claimed in claim 1 where there is only a pair of delivery nozzles.

3. The apparatus for continuously casting metal strip as claimed in claim 1 further comprising:

(e) sensors capable of sensing the positions of the side dams and the positions of the delivery nozzles nearest the side dams, and produce electrical signals indicative of said positions of the side dams and of the delivery nozzles nearest the side dams positions, to the control system, (f) where the control system is capable of controlling the positions of the side dams and the positions of the delivery nozzles nearest the side dams responsive to said electrical signals produced by the sensors so as to adjust the positions of the side dams and of the delivery nozzles nearest the side dams responsive to wear of said the side dams and of the delivery nozzles nearest the side dams.

4. The apparatus for continuously casting metal strip as claimed in claim 1 where, the delivery nozzle actuators and the side dam actuators are selected from the group consisting of servo-mechanisms, hydraulic mechanisms, pneumatic mechanisms, gear mechanisms, cog actuators, drive chain mechanisms, pulley and cable mechanisms, drive screw mechanisms, jack actuators, rack and pinion mechanisms, electro-mechanical actuators, electric motors, linear actuators, and rotating actuators.

* * * * *